US008122906B2

(12) United States Patent
Revheim et al.

(10) Patent No.: US 8,122,906 B2
(45) Date of Patent: Feb. 28, 2012

(54) PRESSURE DRIVEN APPARATUS FOR SEQUENTIAL CONTROL OF A CEMENTING HEAD

(75) Inventors: Sven Revheim, Hafrsfjord (NO); Ommund Revheim, Stavanger (NO)

(73) Assignee: Seawell Oil Tools AS, Stavanger (NO)

( * ) Notice: Subject to any disclaimer, the term of this patent is extended or adjusted under 35 U.S.C. 154(b) by 299 days.

(21) Appl. No.: 12/522,003

(22) PCT Filed: Dec. 18, 2007

(86) PCT No.: PCT/NO2007/000450

§ 371 (c)(1),
(2), (4) Date: Aug. 27, 2009

(87) PCT Pub. No.: WO2008/082307

PCT Pub. Date: Jul. 10, 2008

(65) Prior Publication Data

US 2010/0101775 A1 Apr. 29, 2010

(30) Foreign Application Priority Data

Jan. 5, 2007 (NO) ..... 2007 0086

(51) Int. Cl.
*E21B 33/05* (2006.01)
*E21B 23/00* (2006.01)

(52) U.S. Cl. ..... 137/624.18; 91/36; 91/40

(58) Field of Classification Search ..... 137/624.18, 137/624.12, 624.11; 91/36, 40, 189 R
See application file for complete search history.

(56) References Cited

U.S. PATENT DOCUMENTS 3,115,942 A 12/1963 Arps
3,298,227 A 1/1967 Hicks
(Continued)

FOREIGN PATENT DOCUMENTS

EP 0 837 216 4/1998
(Continued)

OTHER PUBLICATIONS

International Search Report mailed Apr. 11, 2008 for International Application No. PCT/NO2007/000450.

*Primary Examiner* — Kevin Lee
(74) *Attorney, Agent, or Firm* — Wenderoth, Lind & Ponack, L.L.P.

(57) ABSTRACT

A pressure-driven apparatus sequential controls a multiphase operation, e.g., of a cementing head. A transmission arm including a pawl is supported on a cam shaft connected to a pawl cylinder having a built-in return force, directional control valves with a spring return member and roller, operated by the cam plates of the cam shaft, that are staggered relative to each other in a predetermined angle to a pawl disk supported in bearings. The pawl cylinder will rotate cam shaft to a predetermined angular position in the same rotational direction each time the system is supplied with pressure, and operate the directional valves with rollers, whereby the directional valves will apply pressure to actuators present so that cementing valves or other types of valves will open for a predetermined period of time until a timer control shuts off the pressure supply, the pressure is discharged, and the pawl cylinder returns to the starting position thereof. When pressure is supplied to pawl cylinder after all operating phases have been completed, the cam shaft will rotate further on to return to the starting position thereof, and all directional control valves is closed.

2 Claims, 2 Drawing Sheets

U.S. PATENT DOCUMENTS

| | | | | |
|---|---|---|---|---|
| 4,004,497 | A * | 1/1977 | Scholin et al. | 137/624.18 |
| 4,291,724 | A | 9/1981 | Miller | |
| 4,564,043 | A * | 1/1986 | Trittler | 137/624.18 |
| 4,601,375 | A * | 7/1986 | Hayashi et al. | 192/85.3 |
| 6,039,122 | A | 3/2000 | Gonzalez | |
| 6,056,058 | A | 5/2000 | Gonzalez | |
| 6,390,189 | B1 | 5/2002 | Tienari et al. | |
| 6,827,120 | B2 * | 12/2004 | Last | 160/133 |
| 7,264,059 | B2 | 9/2007 | Akselberg | |
| 2002/0053354 | A1 | 5/2002 | McCanna et al. | |
| 2004/0149448 | A1 | 8/2004 | Akselberg | |

FOREIGN PATENT DOCUMENTS

| | | |
|---|---|---|
| GB | 2 396 662 | 6/2004 |

* cited by examiner

PRESSURE DRIVEN APPARATUS FOR SEQUENTIAL CONTROL OF A CEMENTING HEAD

BACKGROUND OF THE INVENTION

I. Technical Field

The invention relates to a pressure-driven apparatus, such as pneumatically/hydraulically, for sequentially controlling a multiphase operation, e.g. of a cementing head.

II. Description of the Related Art

From the patent literature, the following is cited as prior art:

EP A2 837.216 discloses a cementing head comprising drop balls being held back by a rotary sleeve actuated by hydraulic or pneumatic pressure. The sleeve is rotated so as to open a port, allowing the ball to fall down the well.

The currently used method of operating a cementing head offshore:

The currently used system is manually operated, i.e. an operator must be lifted 5 to 15 meters above the drilling floor in a riding belt depending on how the cementing head is positioned. When the operator has been lifted up to the cementing head, he turns a handle ½ turn, after which he will be lowered down to the drilling floor. This operation is repeated an additional two times in order to release a cementing plug before and after a cementing job.

The Norwegian Petroleum Directorate has imposed a regulation that this operation is to be carried out by remote control, and that no riding belt is to be used for lifting workers up in the air on offshore installations.

SUMMARY OF THE INVENTION

In order to comply with this requirement, according to the invention, a pressure-driven, such as pneumatically/hydraulically driven, apparatus for the sequential control of the multiphase operation of the cementing head has been developed.

The present application relates to a pressure-driven, preferably pneumatically driven apparatus for the sequential control of a multiphase operation, e.g. of a cementing head, the apparatus being characterized in the features set forth in the claims.

DETAILED DESCRIPTION OF THE INVENTION

Figure 1A:
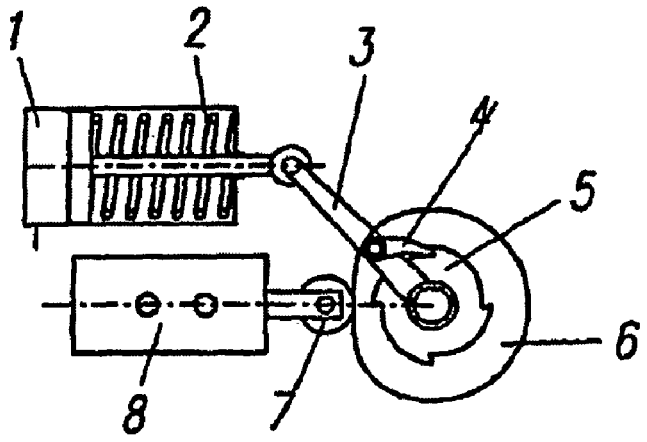
FIGS. 1A, 1B show the control apparatus.

FIG. 1A shows the apparatus in a side view. A transmission arm 3 comprising a pawl 4 is supported on a cam shaft 9 connected to a pawl cylinder 1 having an integrated spring force or some other return load mechanism as well as three directional control valves, 8, 8', 8", and 8‴ having a spring return and roller 7, which is operated by cam plates 6, 6', 6", and 6‴ of cam shaft 9.

Figure 1B:
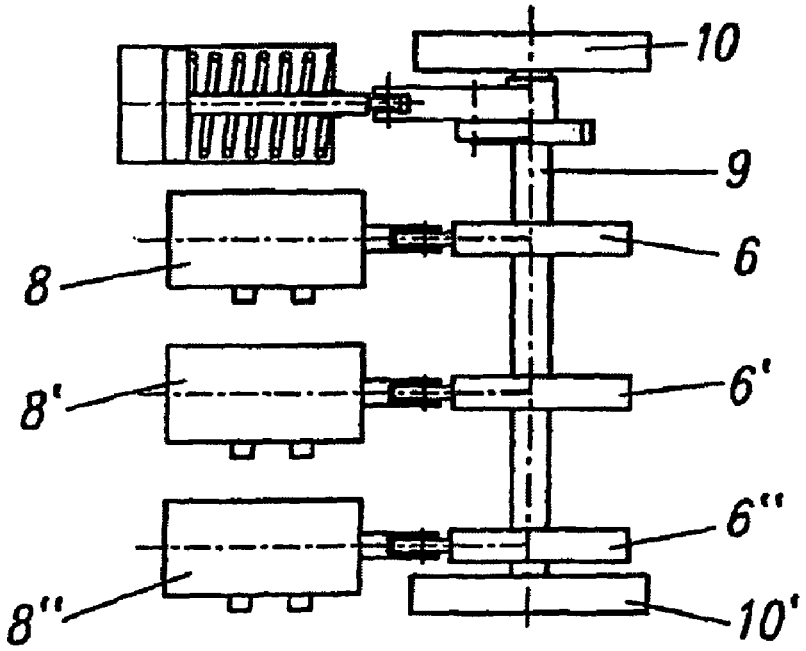

FIG. 1B shows the apparatus in a top view in which a cam shaft 9 with cam plates 6, 6', and 6" that are staggered relative to each other in a predetermined angle to a pawl disk 5 supported in bearings 10 and 10'. Each time the system is supplied with pressure, pawl cylinder 1 with return spring 2 will rotate cam shaft 9 through pawl disk 5 to a particular angular position in the same rotational direction, and thereby operate directional valves 8, 8', 8", and 8‴ with rollers 7 operated by cam plates 6, 6', 6", and 6‴. A pawl disk 5 comprising a predetermined number of catch levers may include one or more wheels.

At the initiation of an operating procedure, none of the valves has been operated, and all valves on the cementing head are in their closed positions.

When pressurized air or another pressurized medium, e.g. hydraulic, is supplied to the sequence controller, pawl cylinder 1 will rotate cam shaft 9 forward to a predetermined angular position, whereby a first directional control valve 8 applies pressure to an actuator present and the first cementing valve or another valve will open for a predefined period of time until a timer control shuts off the pressure supply and the pressure bleeds off through a drain valve and the pawl cylinder 1 returns to the starting position.

On the next time pressure is supplied to pawl cylinder 1, cam shaft 9 with cam plates 6, 6', 6", and 6‴ is rotated further by the predetermined angle, and the second cementing valve or another valve is opened so that both valves are open for a predetermined period of time until a timer relay shuts off the pressure supply and the pressure bleeds off and pawl cylinder 1 returns to the starting position, and on the third and/or following time pressure is supplied, cam shaft 9 is rotated in the same rotational direction to a predetermined angular position and a third directional control valve 8" applies pressure to the actuator, so that all three cementing valves are open for a predetermined period of time until the timer relay shuts off the pressure supply and the pressure is discharged and pawl cylinder 1 returns to the starting position. When pressure is supplied to pawl cylinder 1 after all phases has been completed, cam shaft 9 is rotated further to the predetermined angular position, arriving at the starting position in which all directional valves are in their closed positions.

Figure 2A:
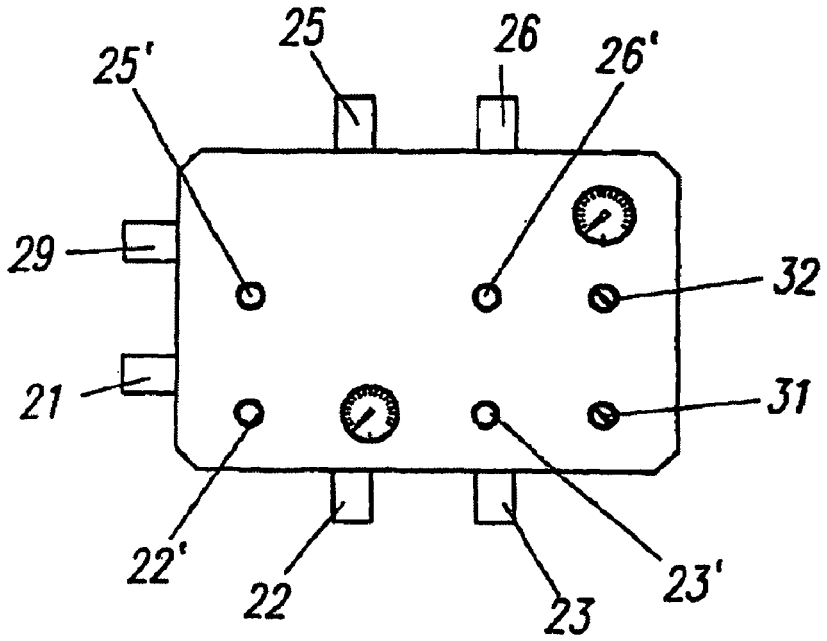
FIGS. 2A, 2B show the control procedure.

Additional information is provided as follows:

FIG. 2A shows a control panel including:

- a valve 21 for supplying pressurized air to a cementing head 30
- a timer relay 29 for setting the operating time for actuators of cementing head 30
- two valves 22, 23, each having a key 22', 23' for initiating the operation of the cementing head or a test valve 24.
- two valves 25, 26 having a flush-mounted push button 25', 26' and a spring return 27 for sequentially controlling cementing head 30
- a valve 28 having a rotary button for locking and closing/opening test valve 24

Sequential procedure:

In order to apply pressure to the sequential control, initially a key-operated valve 22 must be energized by turning the key. Then both sequential valves 25, 26 must be depressed at the same time. Following this, pressure will be supplied to a port on valve 21, and through this port to a timer relay 29 for setting the operating time for the actuators of cementing head 30. Then, valve 23 with key 23' must be closed/locked until the next sequence is run. In the meantime, cement is carried to the fill area. When the time period set for timer relay 29 has expired, a control pulse is sent to a port of valve 21, which shuts off the pressure and drains cementing head 30.

Safety measures:

Should an operator inadvertently depress the sequentially operated valves 25, 26 while the timer relay is engaged or the key-operated valves 22, 23 are locked, this will have no effect on the operation.

The multiphase operation is characterized in a predetermined repeatable sequence for operating actuators/valves in that a cam shaft is rotated a fixed number of angular increments and a fixed number of cam plates until all phases has been completed, so that the actuators/valves are operated as described herein, meaning that each time cementing is to be carried out, the above operation is repeated.

Figure 2B:
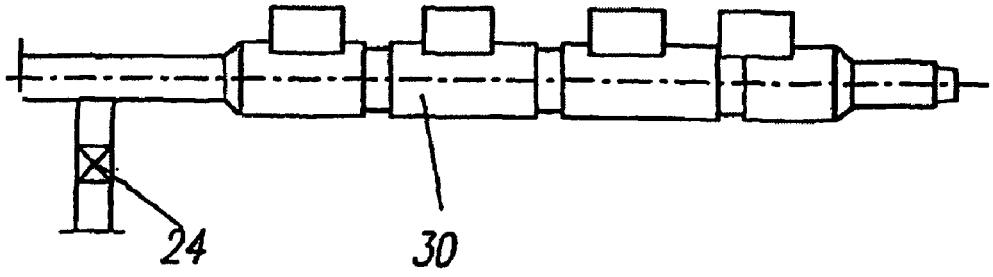

FIG. 2B shows a side view of a cementing head 30 including a test valve 24.

The invention claimed is:

1. A pressure-driven apparatus, for sequential control of a multiphase operation, said apparatus comprising:

a transmission arm comprising a pawl is supported on a cam shaft connected to a pawl cylinder having a built-in return spring or another return load mechanism; and directional control valves, each direction control valve having a spring return and roller capable of being operated by a cam plate of a plurality of cam plates of the cam shaft the cam plates being staggered relative to each other in a predetermined angle to a pawl disk supported in first and second bearings, wherein the pawl cylinder with the built-in return spring, by the pawl disk, will rotate the cam shaft to a set angle in the same rotational direction each time the apparatus is supplied with pressure, and operate each of the directional control valves using the rollers.

2. The pressure-driven apparatus of claim 1, wherein on initiation of an operating procedure, no directional control valve of the directional control valves has been operated, and all directional control valves return to a starting position, when supplied with pressure, the pawl cylinder rotates the cam shaft forward to a predetermined angular position, whereby a first directional control valve of the directional control valves applies pressure to an actuator and a first cementing valve or another valve opens for a predetermined period of time until a timer control shuts off the pressure supply and the pressure is discharged through a drain valve and the pawl cylinder returns to the starting position, the next time pressure is supplied to the pawl cylinder, the cam shaft with the cam plates is rotated further to the predetermined angular position, and a second cementing valve or another valve will open, so that two or more of the cementing valves are open for a predetermined period of time until a timer relay shuts off the pressure supply and the pressure is discharged so that the pawl cylinder returns to the starting position, the third and subsequent time(s) pressure is supplied, the cam shaft is rotated in the same rotational direction to a predetermined angular position, and a an additional directional control valve of the directional control valves applies pressure to the actuators, so that the first and second cementing valves open for a predetermined period of time until the timer relay shuts off the pressure supply and the pressure is discharged and the pawl cylinder returns to the starting position, and when pressure is supplied to the pawl cylinder after all operating phases have been completed, the cam shaft is rotated further to the starting position in which all directional valves are in their closed positions.

* * * * *